US005478439A

United States Patent [19]

De La Bruniere et al.

[11] Patent Number: 5,478,439

[45] Date of Patent: Dec. 26, 1995

[54] METHOD FOR FEEDING CELLULOSE PULP MIXTURE TO A PRESSURIZED CONTINUOUS DIGESTER

[75] Inventors: Patrick De La Bruniere; Jean Galichon, both of Paris, France

[73] Assignee: TAG Pulp Industries S.A., Liechtenstein

[21] Appl. No.: 75,476

[22] PCT Filed: Dec. 12, 1991

[86] PCT No.: PCT/FR91/00986

§ 371 Date: Jul. 20, 1993

§ 102(e) Date: Jul. 20, 1993

[87] PCT Pub. No.: WO92/11409

PCT Pub. Date: Jul. 9, 1992

[30] Foreign Application Priority Data

Dec. 17, 1990 [FR] France ..... 90 15759

[51] Int. Cl.[6] ..... D21C 7/06

[52] U.S. Cl. ..... 162/18; 162/17; 162/52; 162/246

[58] Field of Search ..... 162/17, 18, 52, 162/246

[56] References Cited

U.S. PATENT DOCUMENTS

| | | | |
|---|---|---|---|
| 2,975,096 | 3/1961 | Ginaven et al. | 162/18 |
| 3,041,233 | 6/1962 | Richter | 162/18 |
| 4,790,905 | 12/1988 | La Bruniere et al. | 162/77 |
| 4,968,385 | 11/1990 | Amador et al. | 162/18 |

FOREIGN PATENT DOCUMENTS

| | | |
|---|---|---|
| 0136325 | 4/1985 | European Pat. Off. . |
| 2542021 | 9/1984 | France . |
| 8403527 | 9/1984 | WIPO . |

*Primary Examiner*—David L. Lacey
*Assistant Examiner*—Dean T. Nguyen
*Attorney, Agent, or Firm*—Ostrolenk, Faber, Gerb & Soffen

[57] ABSTRACT

A system is provided for feeding wood or annual plant chips to continuous digesters for producing paper pulp. The system comprises two stages: in a first, impregnation stage, the chips are impregnated with a sufficient amount of chemical reagents to allow them to be hot-digested by impregnation in alkaline or alkaline-earth solutions, then drained. In the case of annual plants, the plants are mechanically mixed with alkaline and/or alkaline-earth reagents and a minimal quantity of hot water to obtain a wet fiber-like mixture. In the second stage, the material impregnated above is pumped directly into a pressurized digester (1) by a hydraulic piston pump (2). A plug (4) formed in the pipe (3) between the pump and the digester provides the required seal and pressure resistance.

5 Claims, 1 Drawing Sheet

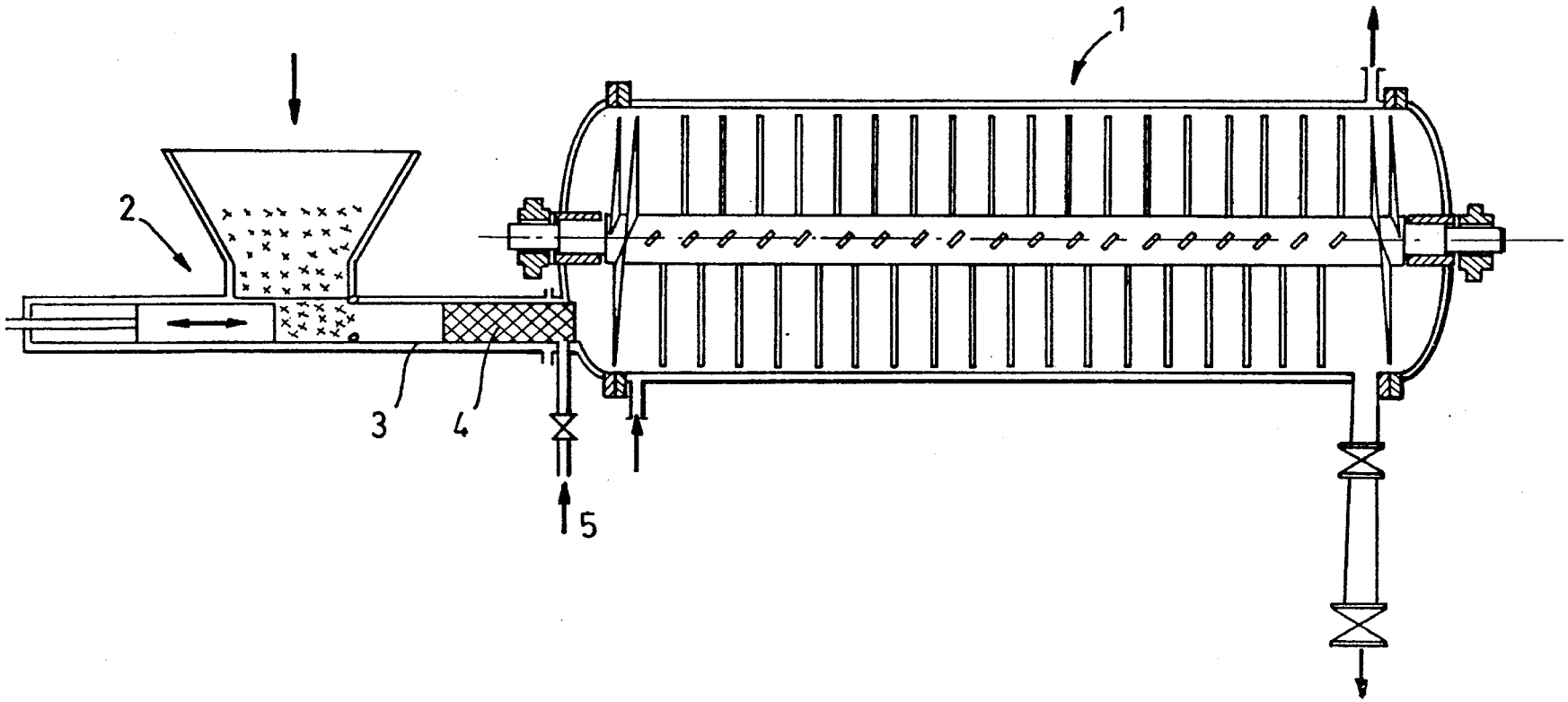
1
2
3
4
5

METHOD FOR FEEDING CELLULOSE PULP MIXTURE TO A PRESSURIZED CONTINUOUS DIGESTER

FIELD OF THE INVENTION

The present invention concerns a method for preparing cellulose pulp by means of cooking of lignocellulose materials, such as wood chips or annual plants, in a continuous cooking reactor and more particularly concerns a method for feeding said reactor.

BACKGROUND OF THE INVENTION

The feeding systems currently used are mostly of the following types:

a—For annual plants:

Truncated or variable pitch continuous screws provided at the extremity of a counter-pressure system. The system makes it possible to avoid any flowing back of the material by means of the vapor pressure, generally about 7 bars, existing inside the cooker.

These screws have a certain number of drawbacks, namely rapid wear owing to the presence of silica in the plants used (cane trash, gambo fiber, straw, hemp, etc), which requires the screws to be changed frequently (for recharging with metal) and, for certain plants (especially humid straw), resulting in rendering it difficult to ensure a regular flow owing to the fact that the material tends to rotate with the screw and move no further.

This drawback adversely affects the quality of the pulp obtained and thus reduces the productivity of the installation.

b—For wood chips, the systems used are rotary valve or sieve type systems. These devices function according to the following cycle:

1. A certain quantity of chips is introduced into a volume at atmospheric pressure.
2. The volume is closed and subjected to a vapor pressure equal to that of the cooker.
3. The volume is opened towards the cooker and the chips are dumped from the cooker.
4. The volume is closed again and then held at atmospheric pressure.

The volume is then ready to receive a new load of chips.

Such systems exhibit drawbacks as they are discontinuous and accordingly disturb the functioning of the cooker and bring about a head loss on each cycle.

SUMMARY OF THE INVENTION

The proposed system may be used both for annual plants and wood chips. It is particularly well-adapted to continuous methods and in particular to the two-stage method, such as the one described in the French utility certificate No 2 542 021 (see also the European patent No 0 136 325 and the U.S. Pat. No. 4,790,905).

A method of preparing a cellulose pulp is already known from U.S. Pat. No. 4,968,385, according to which a cellulose fiber containing material is impregnated with alkaline liquor, the mixture is fed first to a centrifugal pump, where it is subjected to pressure which is only slightly lower than the pressure reigning inside the cooker. The centrifugal pump, whose outlet is provided with a non-return valve, is connected to a screw press, where excess liquid is pressed out.

The pressure difference over the press is kept small, such as about 1 to 2 bars, because the sliding of the material, which occurs when using high pressures in the presence of alkaline liquor, can only be prevented from taking place by using low pressures.

As matter of fact, applying high pressures in a screw press is detrimental to the advance rate of the material in the screw press.

The objective of the invention is to avoid such drawbacks by a method for feeding continuous cooker so as to obtain a cellulose pulp from lignocellulose substances, wherein the impregnated material is fed in form of plug, the imperviousness of the cooker being ensured by the presence of the plug in the feed pipe, characterized in that lignocellulose materials, such as wood chips or annual plants, previously impregnated with chemical reagents in sufficient quantities required to cook them, together with a sufficient quantity of water so as to obtain a pasty but not liquid consistency, are introduced into an open yoke piston pump.

So doing, the rate of advance of the material in the pump is independent of the pressure applied in the presence of alkaline liquor, quite different from what happens in the known installations.

Besides, no non-return valve or flap valve is necessary. Preferently, the impregnation inside the lignocellulose material is provided in two stages:

a) mixture of the impregnation solution in proportions required for cooking by means of conventional agitation, and b) submission of this mixture when being introduced into the cooker to a high pressure, preferably about 80 bars, by means of compression with the aid of an open yoke piston pump, which forces the impregnation solution to penetrate into the lignocellulose material.

BRIEF DESCRIPTION OF THE DRAWINGS

Implementation of the method of the invention shall be described hereafter with reference to the drawing whose sole FIGURE represents a front cutaway view of the cooker 1 fed by an open yoke piston pump 2 i.e., a pump having a cylinder provided with a filling opening—i.e., a pump open to the atmosphere by means of the pipe 3 comprising one vapor inlet 5.

DETAILED DESCRIPTION OF THE PREFERRED EMBODIMENTS

The first stage of the method is impregnation, as described in those patents mentioned earlier. The annual plant is shredded into pieces measuring between 5 and 10 cm, for example. Then hot water and alkali or alkaline-earth reagents required for cooking are added so as to obtain the quality of the sought-after pulp.

In the case of wood chips, these are immersed hot into a solution of alkali or alkaline-earth reagents with a given concentration and for an adequate time so as to absorb from the chips the amount of reagents required for its cooking. Then the chips are drained. Whether this involves annual plants or wood chips, the main object of the invention is to obtain after impregnation an impregnation solution/dry material ratio (IS/DM) of preferably equal or close to 1.5, which may also vary, according to the nature of the raw material used, of between 0.8 and 3.

The second stage of the method includes injection. The impregnated material is injected under pressure by an open yoke piston pump 2 into a pipe 3 connected to the cooker 1 provided with a double casing heated by vapor. The piston pump may have a double body, each piston operating alternately so as to create an almost continuous flow, or be a single body pump.

The pipe line 3 between the outlet of the pump and the inlet of the cooking reactor needs to be long enough and have a sufficient diameter so that the head loss, created by virtue of the formation of a plug 4 resulting from the compression action of the pump piston, is greater than the internal pressure of the reactor. The length of the pipe 3 and its diameter may respectively be between 3 and 5 m and 2 and 300 mm. In these circumstances, it may be observed that the material compressed in this pipe length does not flow back towards the pump and that it constitutes a plug completely impervious to the under-pressure steam of the cooking reactor. Thus, no flap valve or valve system is required. The pumps used are of a type currently available on the market, normally used for other purposes, such as the pumping of liquid concrete. They may easily develop a pressure of 80 bars at the pump outlet, the piston being activated by a hydraulic device, such as a jack.

The results described above may be obtained by virtue of three surprising factors inherent in the present invention:

a) The impregnated material initially has an apparent density of about 0.35 for annual plants and 0.45 for the chips. After compression at 80 bars, this density becomes close to 1.

b) Even with high impregnation rates, such as for IS/DM situated between 2.5 and 3, there is no separation of the liquid phase.

c) The impregnated material easily "slides" into the pipe, the alkaline reagents playing the role of a lubricant, which renders a possible uninterrupted feeding. It most cases, it would be impossible for this system to feed in the same materials which have simply been shredded.

Even in the case where this would be possible, the problems of wear would be the same as those encountered with conventional feed screws. Now, wear traces observed in the system of the invention remain at an imperceptable level and make it possible to foresee a continuous period of service of several years without having to change parts.

EXAMPLE 1

300 kg of hemp with a humidity of 8% and cut to a length of about 5 cm are introduced into the rotary mixer.

| | |
|---|---|
| Added to the mixture are: powdered soda | 45 kg |
| anhydrous powdered sodium carbonate | 15 kg |
| hot water | 500 kg |

The mixture with these added substances is vigorously agitated for ten minutes. Finally, a mixture is obtained with the fully homogeneous aspect of humid fibers.

This total weight of 860 kg shall be introduced into a Putzmeister type (CK01061) piston pump with hydraulic control. The pump is connected to an experimental cooker constituted of an horizontal cylinder 4 m long and 0.60 m diameter by means of a pipe 6 m long and 200 mm diameter.

Pumping is started at the rate of 5 to 6 strokes per minute. After about 11 minutes, the impregnated hemp appears at the extremity of the 6 m tube. This can be verified by leaving the flange joining the pipe to the cooker slightly ajar.

At this stage, this flange is tightly screwed down and the cooker temperature is adjusted to 170° C. by steam-pressurizing at 7 bars. The pipe connecting the pump to the cooker has neither any valve nor flap valve.

Pumping is carried out easily, the substance being pumped in slightly over 50 minutes.

During pumping, there was no separation of the impregnated mass. The density of the substance having passed through the feed pipe and measured during a preliminary test was almost 1.

The plug made of a compressed material is fully sealed in the feed pipe.

EXAMPLE 2

Similarly to the previous example, by using 300 kg of bales of non cut barley straw, the following is introduced into the mixer:

| | |
|---|---|
| 10 bales of straw, namely | 300 Kg |
| powdered soda | 40 Kg |
| anhydrous powdered sodium carbonate | 12 kg |
| sprayed hot water | 470 kg |

The mixture is vigorously agitated for 10 minutes. The homogeneous product obtained has the appearance of humid straw.

With the same pump described above and in accordance with the same operational conditions, the impregnated straw is introduced into the cooker whose internal pressure is 7 bars, the period for introduction lasting 50 minutes.

Here again, the plug is completely sealed and the cooker functions trouble-free despite the compaction and densification of the substance at the cooker inlet. In addition, its has been established that the density of the compressed impregnated straw is close to 1, whereas its initial apparent density is about 0.35.

EXAMPLE 3

280 kg of SALIGNA 12 A.B.L. Eucalyptus chips with a 92% dry content and placed in a stainless steel basket perforated with holes are immersed in a soda solution containing 102.4 g/l of NaOH at 100° C. for 30 minutes. The chips with a thickness of 2.5 mm and about 2 cm long are then removed from the solution and drained for 5 minutes. The weight of the chips after impregnation is 580 kg.

By using the same equipment as used earlier, these chips are pushed into the experimental cooker whose internal pressure is 7 bars and temperature is 170° C. The pipe connecting the outlet of the pump to the inlet of the cooker is 5 m long and has a diameter of 200 mm. During introduction, which lasts about 35 minutes, it has been established that there is no loss of vapor inside this pipe or any drying of the impregnation liquid under the effect of the pressure exerted by the pump piston.

We claim:

1. A method for feeding a continuous cooker operating under internal pressure to produce a cellulose pulp which comprises providing a combination of lignocellulose material impregnated with water and the chemical reagents for cooking the lignocellulose material in an amount sufficient to cook the lignocellulose material and wherein the impregnated reagents/lignocellulose material weight ratio of the combination is between 0.8 and 3, introducing said combination into a filling opening inlet of a piston pump having a cylinder and wherein said opening inlet is open to the atmosphere, said piston pump being connected to the cooker through a feed pipe, and operating the pump so as to cause said combination to form a plug and to move the plug through the feed pipe to the cooker, said plug producing a head loss in said feed pipe greater than the internal pressure of the cooker, thereby isolating the cooker from the pump.

2. The method according to claim 1 in which the impregnation reagents/lignocellulose material weight ratio is equal to or about 1.5.

3. The method according to claim 2 in which the pump is operated so as to cause compression of the lignocellulose material to a density of about 1.

4. The method of claim 3 in which the pipe has a length between 3 and 5 meters and a diameter between 200–300 mm.

5. The method according to claim 1 in which the pump is operated so as to cause compression of the lignocellulose material to a density of about 1.

* * * * *